US010103477B1

(12) United States Patent
Hsieh et al.

(10) Patent No.: US 10,103,477 B1
(45) Date of Patent: Oct. 16, 2018

(54) WATERPROOF NETWORK TYPE BOARD END CONNECTOR

(71) Applicant: Matrix Electronic Co., Ltd, Taoyuan (TW)

(72) Inventors: Ming-En Hsieh, Taoyuan (TW); Peng Li, Taoyuan (TW)

(73) Assignee: Matrix Electronic Co., Ltd., Taoyuan (TW)

( * ) Notice: Subject to any disclaimer, the term of this patent is extended or adjusted under 35 U.S.C. 154(b) by 0 days.

(21) Appl. No.: 15/917,818

(22) Filed: Mar. 11, 2018

(30) Foreign Application Priority Data

Jan. 30, 2018 (TW) ..... 107201470 U

(51) Int. Cl.

| | |
|---|---|
| ***H01R 9/24*** | (2006.01) |
| ***H01R 13/52*** | (2006.01) |
| ***H01R 24/64*** | (2011.01) |
| ***H01R 13/24*** | (2006.01) |
| ***H01R 12/72*** | (2011.01) |
| ***H01R 13/424*** | (2006.01) |
| *H01R 107/00* | (2006.01) |

(52) U.S. Cl.
CPC ..... *H01R 13/521* (2013.01); *H01R 12/724* (2013.01); *H01R 13/2442* (2013.01); *H01R 13/424* (2013.01); *H01R 13/5219* (2013.01); *H01R 24/64* (2013.01); *H01R 2107/00* (2013.01)

(58) Field of Classification Search
CPC ..... H01R 24/64
USPC ..... 439/676, 620.17, 620, 23
See application file for complete search history.

(56) References Cited

U.S. PATENT DOCUMENTS

| | | | | |
|---|---|---|---|---|
| 5,989,069 | A * | 11/1999 | Tan | H01R 13/719 439/620.23 |
| 6,159,050 | A * | 12/2000 | Belopolsky | H01R 13/719 439/620.15 |
| 6,848,949 | B2 * | 2/2005 | Mullaney | H01R 13/7032 439/521 |
| 7,090,542 | B2 * | 8/2006 | Zheng | H01R 13/514 439/676 |
| 8,632,367 | B2 * | 1/2014 | Caveney | H01R 13/6466 439/676 |
| 8,951,073 | B2 * | 2/2015 | Zhang | H01R 13/64 439/676 |
| 9,350,110 | B1 * | 5/2016 | Ma | H01R 13/521 |
| 9,768,544 | B2 * | 9/2017 | Du | H01R 13/521 |
| 9,780,504 | B2 * | 10/2017 | Wang | H01R 24/60 |
| 9,991,625 | B2 * | 6/2018 | Ozaki | H01R 13/5219 |

* cited by examiner

*Primary Examiner* — Neil Abrams

(57) ABSTRACT

A waterproof network type board end connector includes an insulative housing including a partition and a protrusion protruded from one side of the partition, and an electrical module mounted in the insulative housing and including a terminal block, a baffle abutted to the protrusion to isolate the mating connection chamber and the positioning chamber, output terminals inserted through the baffle and positioned in one side of the terminal block and input terminals positioned in an opposite side of the terminal block.

3 Claims, 8 Drawing Sheets

WATERPROOF NETWORK TYPE BOARD END CONNECTOR

BACKGROUND OF THE INVENTION

1. Field of the Invention

The present invention relates to electrical connector technology, and more particularly to a waterproof network type board end connector, which has a water and dust proof function even it is not connected with a network plug connector.

2. Description of the Related Art

In a waterproof network connector assembly (RJ45), the waterproof design is provided between the female network connector and the male network connector, i.e., the waterproof function is actuated only when the male network connector and the female network connector are connected. This waterproof design has drawback as follows:

1. After fabrication of the male network connector and the female network connector, an extra waterproof procedure is necessary, increasing the cost and complicating the manufacturing process.

2. The female network connector does not provide any waterproof function before the connection of mating male network connector, thus, the female network connector and the electronic product using the female network connector tend to get moisture damage.

SUMMARY OF THE INVENTION

The present invention has been accomplished under the circumstances in view. It is therefore the main object of the present invention to provide a waterproof network type board end connector, which facilitates installation, has a water and dust proof function even it is not connected with a network plug connector, and is inexpensive to manufacture.

To achieve this and other objects of the present invention, a waterproof network type board end connector comprises an insulative housing and an electrical module. The insulative housing comprises a body, a partition disposed in the body, a mating connection chamber defined in the insulative housing at one side relative to the partition, a positioning chamber defined in the insulative housing at an opposite side relative to the partition, a protrusion protruded from the partition and facing toward the positioning chamber, a mounting groove extending around the protrusion and disposed to face toward the positioning chamber, a plurality of first positioning grooves arranged in a bottom side of the mating connection chamber, and a plurality of second positioning grooves arranged on one side of the protrusion in communication with the respective first positioning grooves. The electrical module comprises a terminal block positioned in the positioning chamber of the insulative housing, a baffle positioned in the mounting groove of the insulative housing to isolate the positioning chamber from the mating connection chamber, a plurality of output terminals disposed in one side of the terminal block, and a plurality of input terminal disposed in an opposite side of the terminal block. The output terminals each comprise a transmission portion positioned in one respective first positioning groove of the insulative housing, a bonding portion curved from one end of the transmission portion positioned in one respective second positioning groove of the insulative housing, and a contact portion curved from an opposite end of the transmission portion toward the bonding portion and suspending in the mating connection chamber. The baffle comprises a first abutment portion disposed between the terminal block and the output terminals, a second abutment portion curved from one end of the first abutment portion at a predetermined angle, and a plurality of terminal holes located on the second abutment portion for the passing of the bonding portions of the respective output terminals.

DETAILED DESCRIPTION OF THE PREFERRED EMBODIMENT

Figure 1:
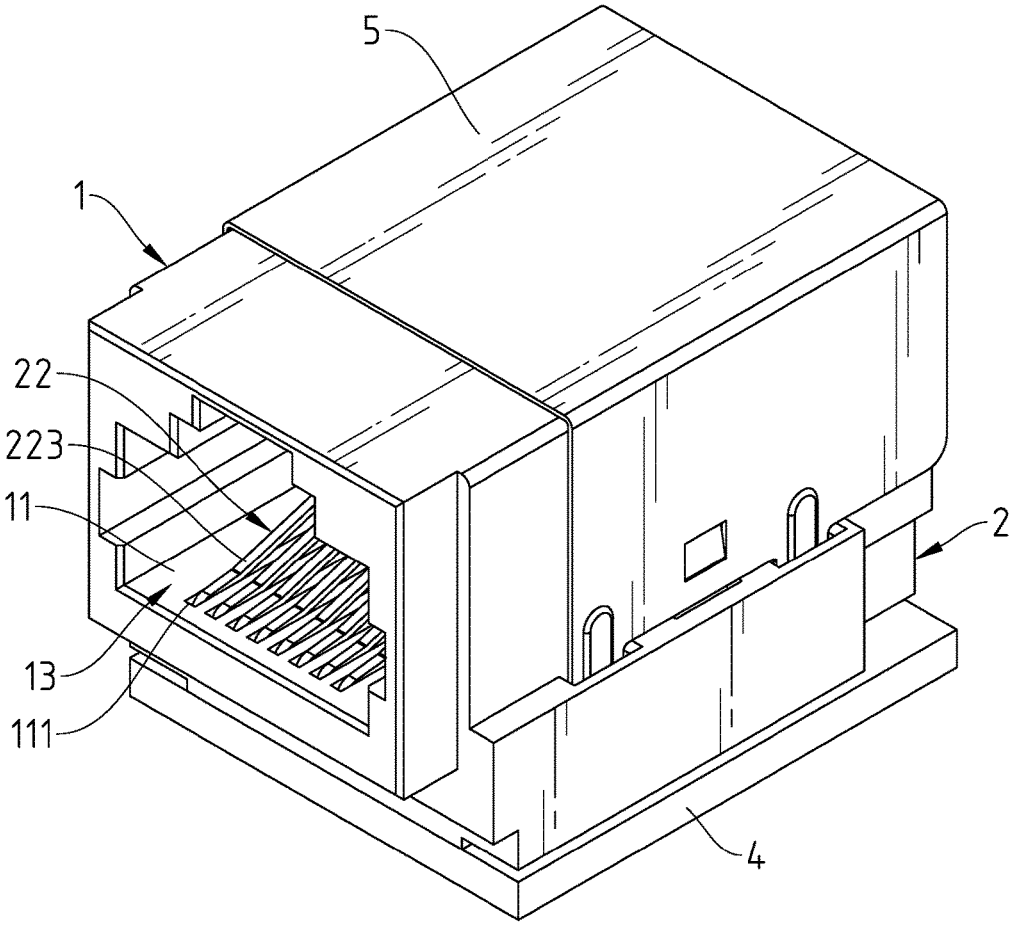
FIG. 1 is an oblique top elevational view of a waterproof network type board end connector in accordance with the present invention.
Figure 2:
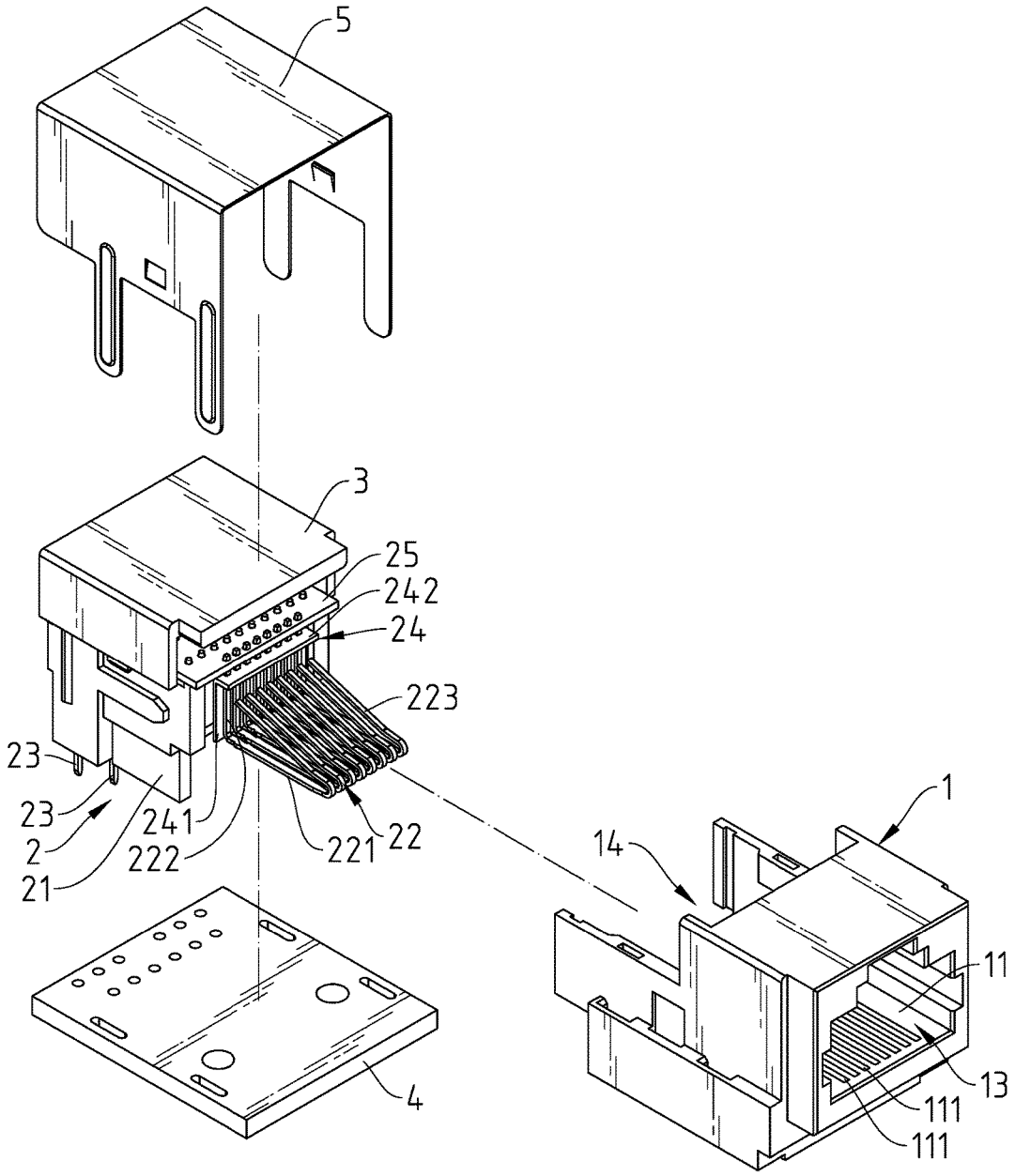
FIG. 2 is an exploded view of the waterproof network type board end connector in accordance with the present invention.
Figure 3:
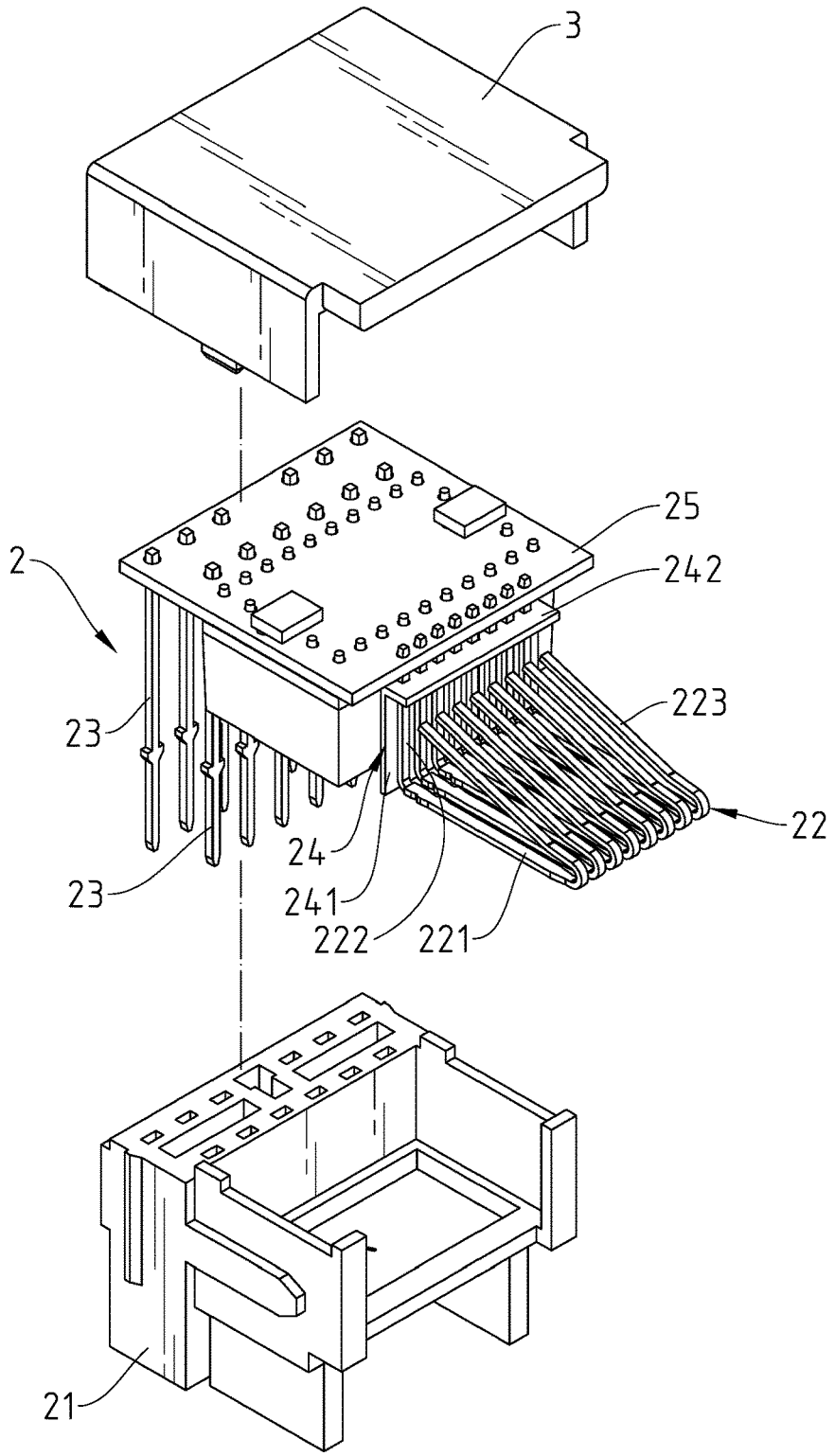
FIG. 3 is an exploded view of the electrical module.
Figure 4:
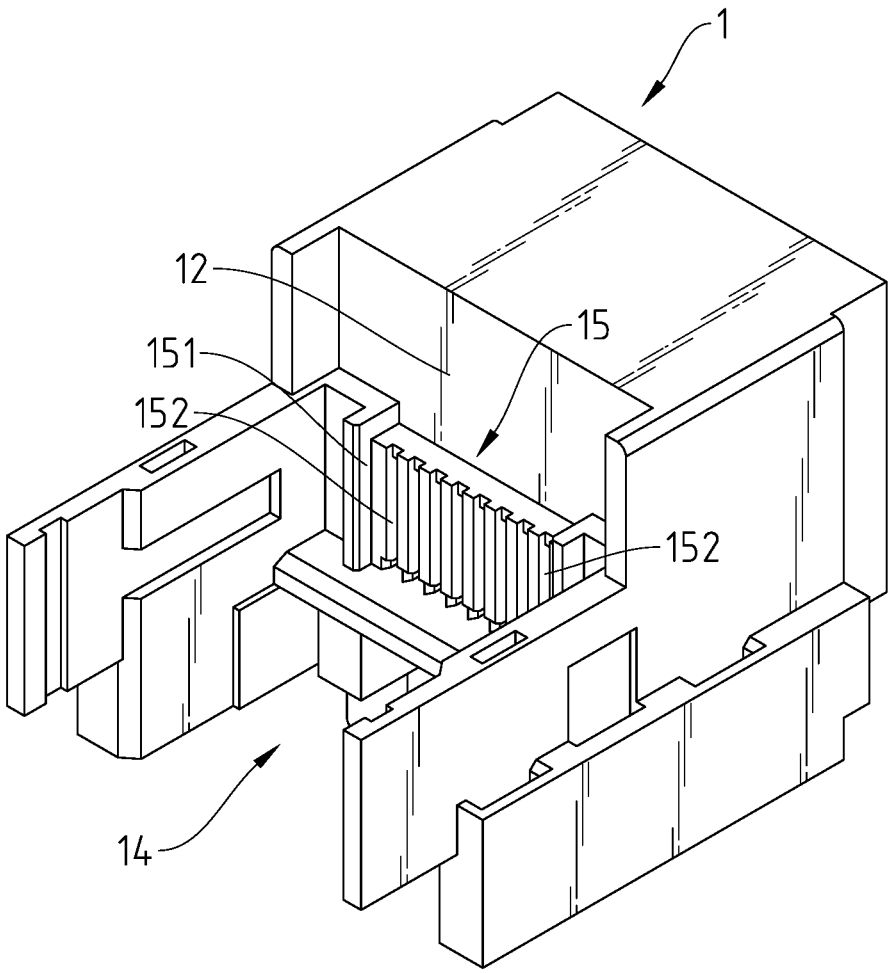
FIG. 4 is an elevational view of the insulative housing.
Figure 5:
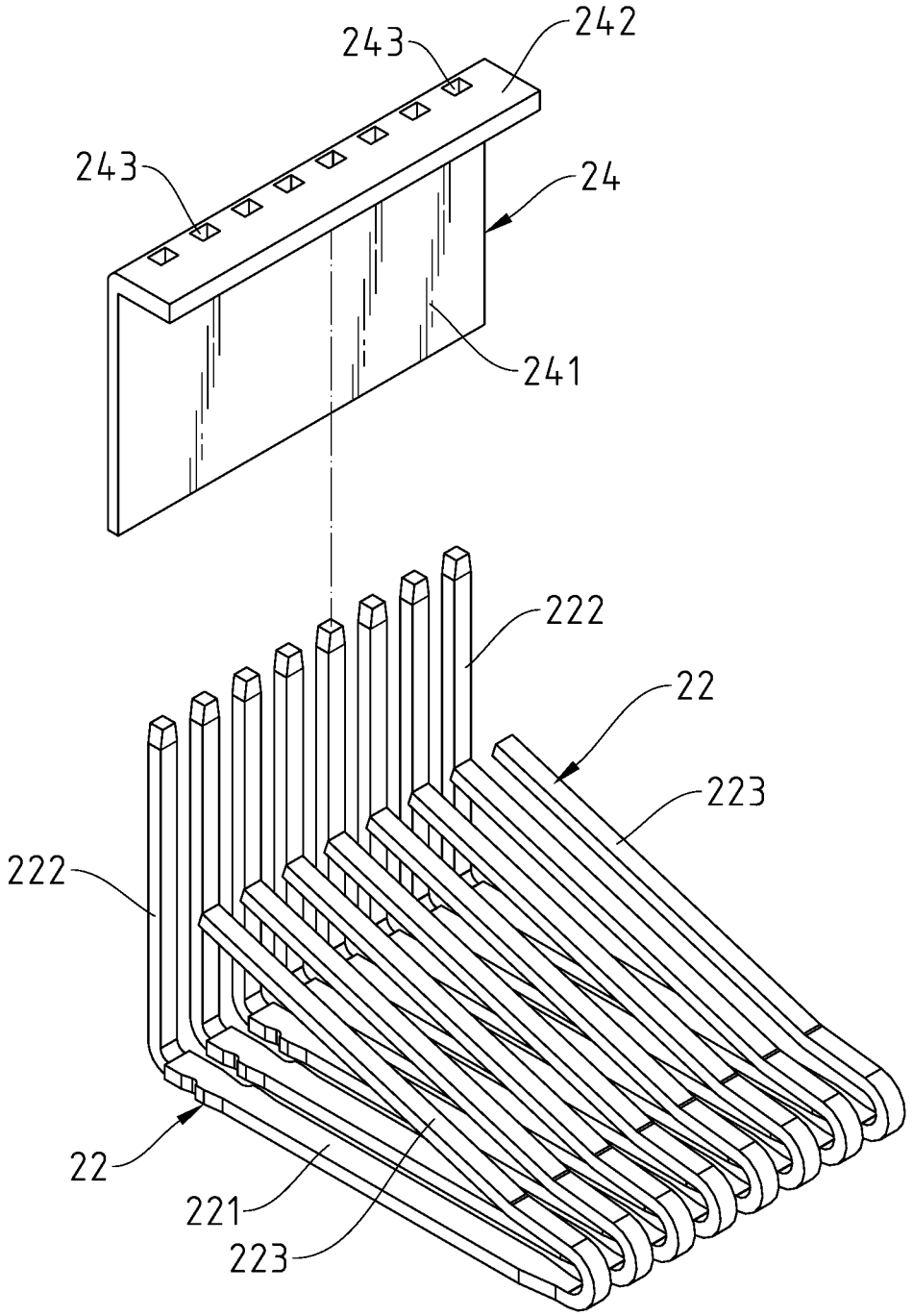
FIG. 5 is an exploded view illustrating the relationship between the baffle and the output terminals.

Referring to FIGS. 1-5, a waterproof network type board end connector in accordance with the present invention is shown. The waterproof network type board end connector comprises an insulative housing 1, electrical module 2, a top cover 3, a substrate 4, and a EMI shielding shell 5.

The insulative housing 1 comprises a body 11, a partition 12 disposed in the body 11, a mating connection chamber 13 defined in the insulative housing 1 at one side relative to the partition 12, a positioning chamber 14 defined in the insulative housing 1 at an opposite side relative to the partition 12, a protrusion 15 protruded from the partition 12 and facing toward the positioning chamber 14, a plurality of first positioning grooves 111 horizontally arranged in a bottom side of the mating connection chamber 13 and cut through a bottom side of the protrusion 15 into the positioning chamber 14, a mounting groove 151 extending around the protrusion 15 and disposed to face toward the positioning chamber 14, a plurality of second positioning grooves 152 vertically arranged on one side of the protrusion 15 to face toward the positioning chamber 14 and extending through opposing top and bottom sides of the protrusion 15 and respectively perpendicularly disposed in communication with the respective first positioning grooves 111.

The electrical module 2 comprises a terminal block 21, a baffle 24, a circuit board 25, a plurality of output terminals 22 electrically connected to one side of the circuit board 25 and a plurality of input terminals 23 electrically connected to an opposite side of the circuit board 25. The circuit board 25 is mounted on a top side of the terminal block 21 to hold the output terminals 22 and the input terminals 23 at opposing front and rear sides of the terminal block 21. The input terminal 23 are respectively plugged into the terminal block 21. The output terminals 22 each comprise a transmission portion 221, a bonding portion 222 curved from one end of the transmission portion 221 and bonded to the circuit board 25, and a contact portion 223 curved from an opposite end of the transmission portion 221 toward the bonding portion 222. The baffle 24 comprises a first abutment portion 241 and a second abutment portion 242 extended from one end of the first abutment portion 241 at a predetermined angle, and a plurality of terminal holes 243 located on the second abutment portion 242 for the passing of the bonding portions 222 of the output terminals 22. Thus, the first abutment portion 241 is disposed between the terminal block 21 and the output terminals 22.

Figure 6:
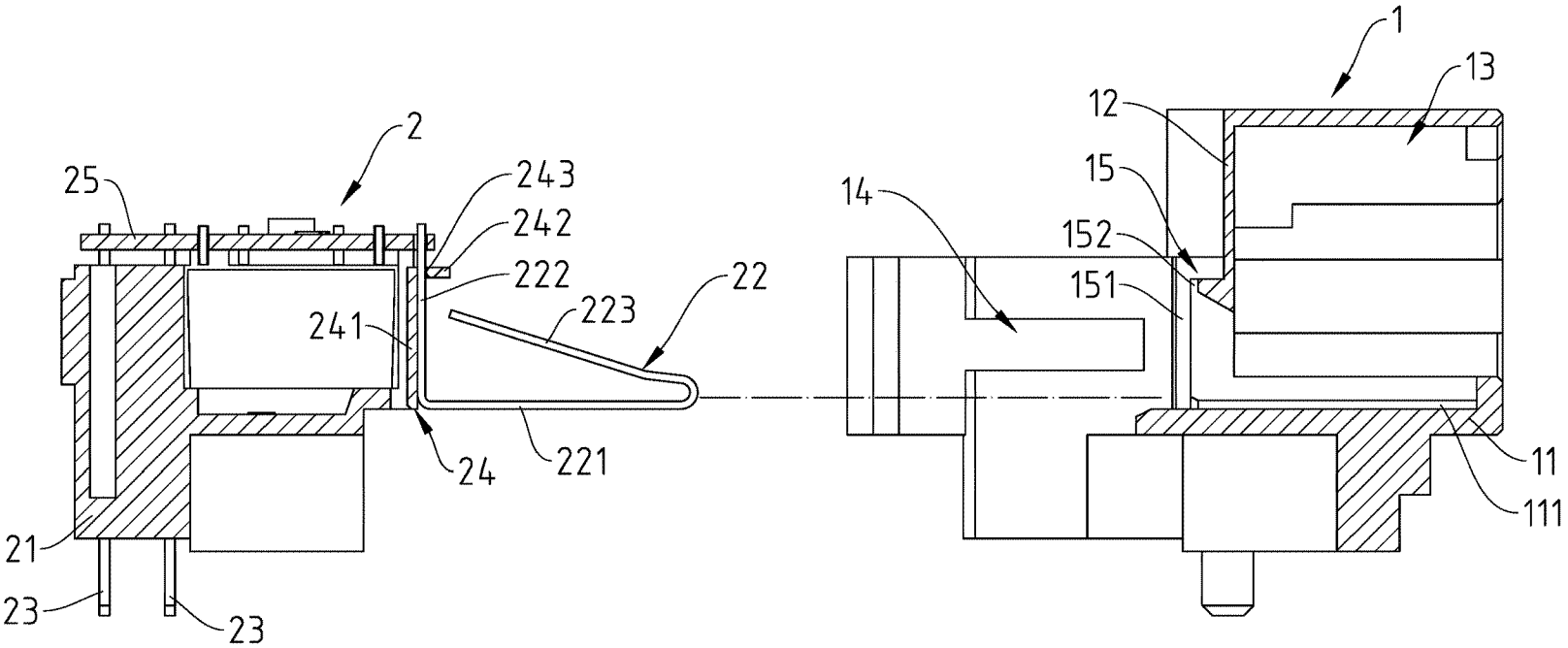
FIG. 6 is a sectional exploded view of the electrical module and the insulative housing.
Figure 7:
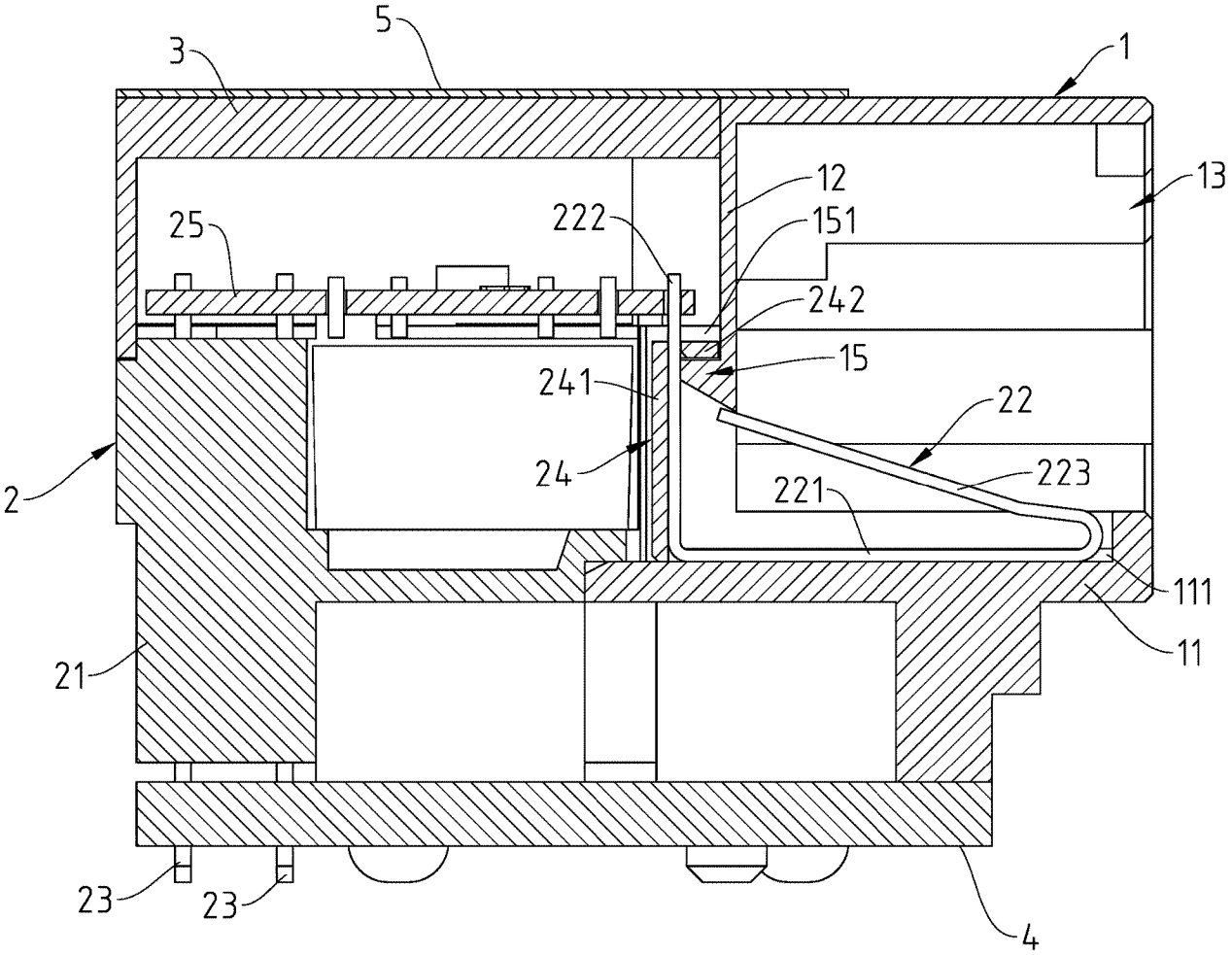
FIG. 7 is a sectional view of the waterproof network type board end connector in accordance with the present invention.

Referring to FIGS. 6 and 7 and FIGS. 1-4 again, when mounting the terminal block 21 of the electrical module 2 in the positioning chamber 14 of the insulative housing 1, the transmission portions 221 of the output terminals 22 are respectively positioned in the respective first positioning grooves 111, the bonding portions 222 of the output terminals 22 are respectively positioned in the respective second positioning grooves 152, and the contact portions 223 of the output terminals 22 are suspended in the mating connection chamber 13. At this time, the baffle 24 is positioned in the mounting groove 151 around the protrusion 15 with the first abutment portion 241 disposed in a bottom side of the mounting groove 151 and the second abutment portion 242 disposed in a top side of the mounting groove 151 to isolate the mating connection chamber 13 from the positioning chamber 14. Thereafter, cover the top cover 3 on the insulative housing 1, then position the insulative housing 1 on the substrate 4, and then cover the EMI shielding shell 5 over the insulative housing 1 to finish installation.

Figure 8:
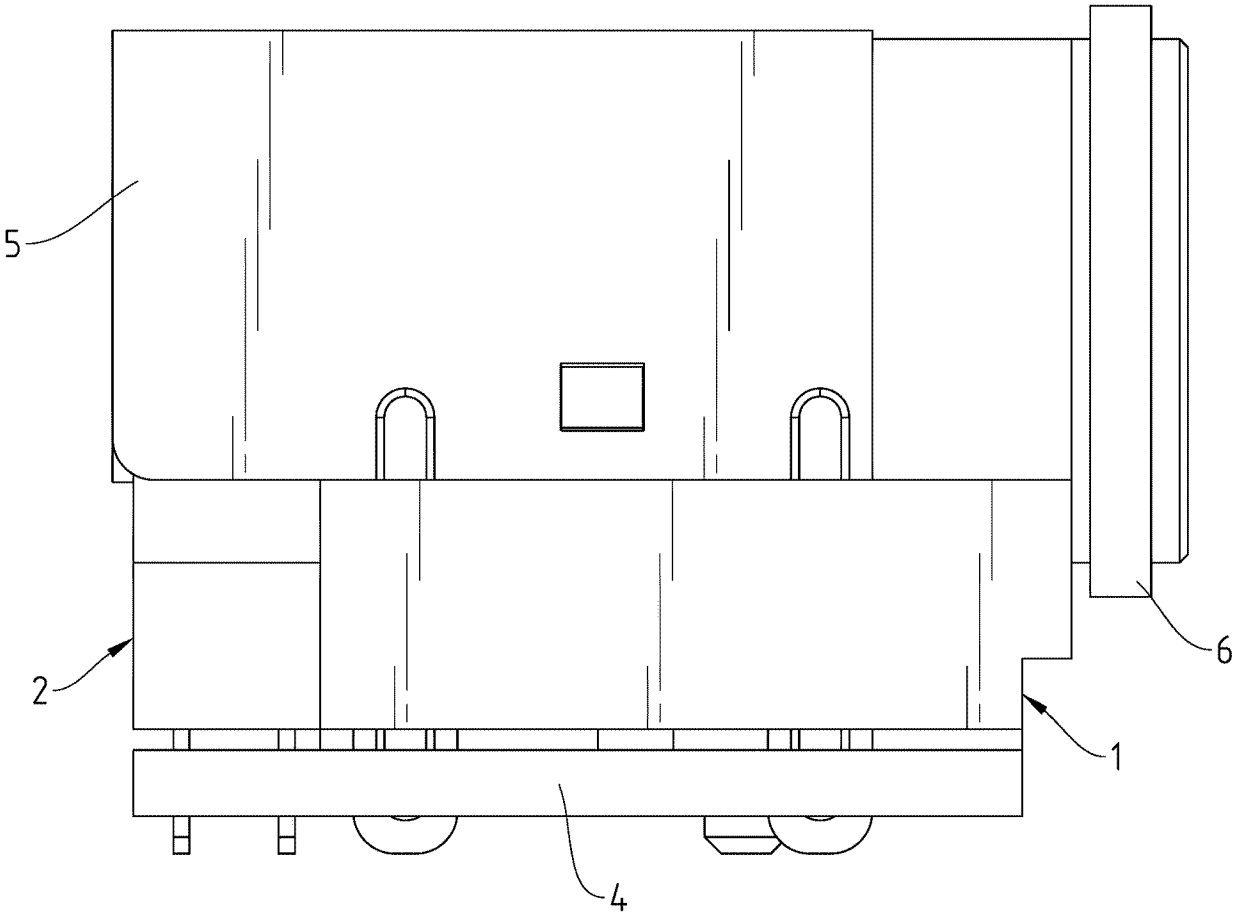
FIG. 8 is a side view of the present invention, illustrating a gasket attached onto the housing.

Referring to FIG. 8, a gasket 6 is attached onto the insulative housing 1 around the mating connection chamber 13 to provide a waterproof function when the insulative housing 1 is mounted in an outer shell of an electronic product or connected with a mating network plug connector.

What the invention claimed is:

1. A waterproof network type board end connector, comprising:

an insulative housing comprising a body, a partition disposed in the body, a mating connection chamber defined in said insulative housing at one side relative to said partition, a positioning chamber defined in said insulative housing at an opposite side relative to said partition, a protrusion protruded from said partition and facing toward said positioning chamber, a mounting groove extending around said protrusion and disposed to face toward said positioning chamber, a plurality of first positioning grooves arranged in a bottom side of said mating connection chamber, and a plurality of second positioning grooves arranged on one side of said protrusion in communication with the respective said first positioning grooves; and an electrical module comprising a terminal block positioned in said positioning chamber of said insulative housing, a baffle positioned in said mounting groove of said insulative housing to isolate said positioning chamber from said mating connection chamber, a plurality of output terminals disposed in one side of said terminal block and a plurality of input terminal disposed in an opposite side of said terminal block, said output terminals each comprising a transmission portion positioned in one respective said first positioning groove of said insulative housing, a bonding portion curved from one end of said transmission portion positioned in one respective said second positioning groove of said insulative housing and a contact portion curved from an opposite end of said transmission portion toward said bonding portion and suspending in said mating connection chamber, said baffle comprising a first abutment portion disposed between said terminal block and said output terminals, a second abutment portion curved from one end of said first abutment portion at a predetermined angle and a plurality of terminal holes located on said second abutment portion for the passing of the bonding portions of the respective said output terminals.

2. The waterproof network type board end connector as claimed in claim 1, wherein said first positioning grooves of said insulative housing are horizontally arranged in the bottom side of said mating connection chamber and cut through a bottom side of said protrusion into said positioning chamber; said second positioning grooves are vertically arranged on one side of said protrusion to face toward said positioning chamber and extending through opposing top and bottom sides of said protrusion and respectively perpendicularly disposed in communication with the respective said first positioning grooves.

3. The waterproof network type board end connector as claimed in claim 1, further comprising a gasket attached onto said insulative housing around said mating connection chamber.

* * * * *